United States Patent [19]

Ozeki et al.

[11] 4,023,248

[45] May 17, 1977

[54] METHOD OF ASSEMBLING APEX SEAL MEANS IN ROTARY PISTON ENGINES

[75] Inventors: Hiroshi Ozeki; Noriyuki Kurio, both of Hiroshima, Japan

[73] Assignee: Toyo Kogyo Co., Ltd., Japan

[22] Filed: June 18, 1975

[21] Appl. No.: 587,815

[30] Foreign Application Priority Data

June 19, 1974 Japan ..... 49-70491

[52] U.S. Cl. ..... 29/156.6; 29/423; 277/9.5; 418/121

[51] Int. Cl.[2] ..... B23P 15/08; F01C 19/10

[58] Field of Search ..... 29/156.6, 156.4 R, 423; 277/81 P, 81 S, 9.5; 418/121, 122, 123

[56] References Cited

UNITED STATES PATENTS

| | | | |
|---|---|---|---|
| 2,140,710 | 12/1938 | Meisel | 29/156.6 |
| 3,745,630 | 7/1973 | Bensinger | 29/156.6 |

OTHER PUBLICATIONS

B413,546, Jan. 1975, Ferchland, 29/156.4 R.

*Primary Examiner*—C.W. Lanham
*Assistant Examiner*—Daniel C. Crane
*Attorney, Agent, or Firm*—Fleit & Jacobson

[57] ABSTRACT

In rotary piston engines including apex seals each comprising a main body constituting a substantial part of the seal, an end piece disposed in abutting relationship to an end of the main body through slanted cam surfaces which serve to force the end piece axially outwardly to engage with the inner surface of the side housing when the end piece is resiliently biased radially outwardly by spring means, the method of assembling the apex seals in the rotary piston engine, which comprises providing a projection of consumable material between the main body of each seal and the spring means so as to retain the spring means preventing the end piece from being displaced over the end face of the center housing, the consumable material being of such a type that dissipates under heat produced during engine operation.

12 Claims, 9 Drawing Figures

METHOD OF ASSEMBLING APEX SEAL MEANS IN ROTARY PISTON ENGINES

The present invention relates to rotary piston type internal combustion engines and more particularly to a method for assembling apex seal means in such rotary piston engines.

In a rotary piston type engine comprising a casing which includes a center or rotor housing having a multiple-lobed trochoidal inner wall surface and a pair of side housings air-tightly secured to the opposite sides of the center housing to define a cavity with the center housing, and a substantially polygonal rotor disposed in said cavity with its apices in sliding engagement through apex seal means with the inner wall surface of the center housing, it has been known to divide the apex seal means for each apex portion of the rotor into two or three parts in order to improve the function of the seal means. This type of apex seal means comprises a main body constituting the substantial part of the seal and at least one of end piece disposed with end-to-end relationship with the main body. The main body and the end piece of the seal are disposed in an apex seal groove formed for the purpose in each apex portion of the rotor. An arcuate leaf spring is provided in such a manner that one end engages with the main body of the seal, the other end with the end piece, and the intermediate portion with the bottom of the seal groove so that the seal main body and the end piece are resiliently forced against the trochoidal inner wall surface of the center housing into sealing engagement therewith. The main body and the end piece of the apex seal are in abutting engagement with each other through slanted cam surfaces which are so formed that, when the end piece is forced radially outwardly under the influence of the leaf spring with respect to the main body of the seal, the main body and the end piece are also forced axially outwardly into sliding engagement with the inner wall surfaces of the adjacent side housings.

In assembling this type of seal means, difficulties have often been encountered in that the seal end piece is pushed out in the radial outward direction beyond the nominal position and the tapered corner portion of the seal end piece is caught between the end surface of the center housing and the adjacent side housing which is attached to the center housing at the final stage of the assembling operation. This may result in damages in the seal end piece or in the center housing.

The present invention has an object to eliminate the aforementioned problems in a conventional method of assembling apex seal means.

Another object of the present invention is to provide an apex seal assembling method in which the end piece is free from spring bias force during assembling operation.

The above and other objects of the present invention can be accomplished by a method of assembling apex seal means in rotary piston engines comprising a casing which includes a center housing having a multiple-lobed trochoidal inner wall surface and a pair of side housings air-tightly secured to the opposite sides of the center housing to define a cavity with the center housing, and a substantially polygonal rotor disposed in said cavity with its apices in sliding engagement through apex seal means with the inner wall surface of the center housing, said seal means including a main body constituting substantial part of the seal means and being adapted to be received in an apex seal groove formed in each apex portion of the rotor, at least one end piece in abutting engagement with an end of the main body through slanted surfaces which incline in axial outward direction as seen in radially outwardly, and spring means disposed in said apex seal groove and having one end adapted to engage with said end piece to force it in radial outward direction, the method being characterized by providing projection means between said main body and the spring means in such a manner that it prevents said end of spring means from forcing the end piece, said projection means being constituted by a material which can be dissipated by heat produced in engine operation.

The above and other objects and features of the present invention will become apparent from the following descriptions of the preferred embodiments taking reference to the accompanying drawings, in which.

Figure 1:
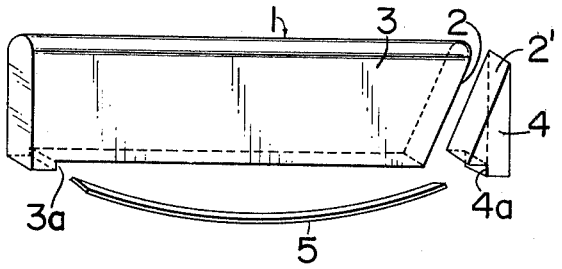
FIG. 1 PRIOR ART
FIG. 1 is a perspective view of a conventional apex seal means to which the present invention is applied.

Referring now to the drawings, particularly to FIG. 1, there is shown apex seal means 1 which comprises an elongated main body 3 having a slanted cam surface 2 at one end thereof. The seal means 1 also includes an end piece 4 which is disposed in abutting relationship with respect to the slanted end 2 of the main body 3. The end piece 4 has a slanted cam surface 2′ which is adapted to be brought into sliding engagement with the cam surface 2 on the main body 3. The end piece 4 has a substantially triangular side configuration as shown in FIG. 1 and is provided with a stepped portion 4*a* at the bottom side thereof. The main body 3 is also provided at the bottom side thereof with a stepped portion 3*a*. An arcuate leaf spring 5 is provided to engage at its opposite ends with the stepped portions 3*a* and 4*a* of the main body 3 and the end piece of the seal.

Figure 2:
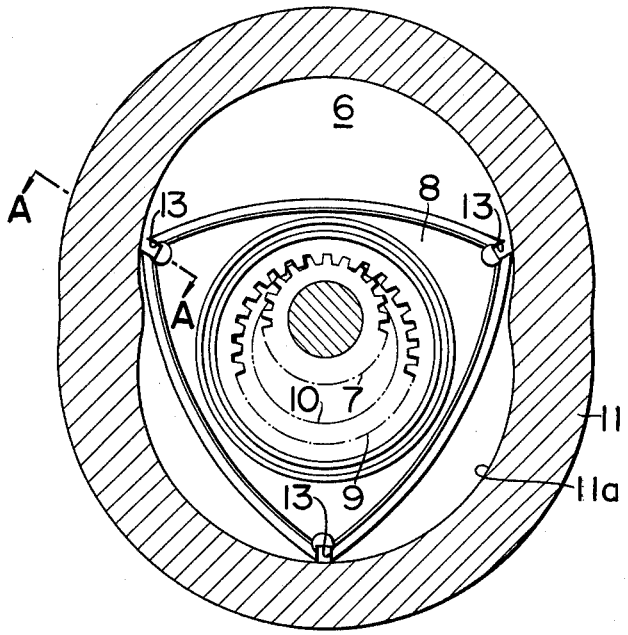
FIG. 2 PRIOR ART
FIG. 2 is a sectional view of a typical rotary piston engine in which apex seals of the type shown in FIG. 1 are used.
Figure 3:
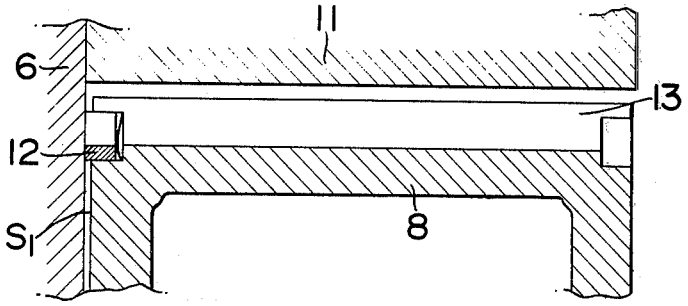
FIG. 3 PRIOR ART
FIG. 3 is a sectional view taken substantially along the line A—A in FIG. 2.
Figure 4:
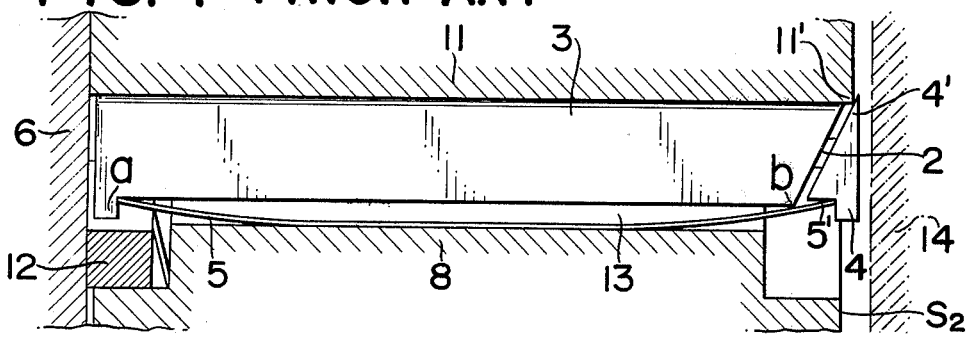
FIG. 4 PRIOR ART
FIG. 4 is a sectional view showing a conventional method for assembling the apex seal means.

FIG. 2 shows a typical rotary piston type engine to which the apex seals of the type shown in FIG. 1 are applied. The engine includes a casing which comprises a center or rotor housing 11 having a two-lobed trochoidal inner wall surface 11*a*, and a pair of side housings 6 sealingly secured to the opposite ends of the center housing 11. In FIG. 2, only one of the side housings 6 is shown in order to show the interior of the casing. In the casing, there is disposed a substantially triangular rotor 8 which has an apex seal groove 13 in each apex portion thereof. The apex seal 1 shown in FIG. 1 is received in each apex seal groove 13. The spring 5 forces the main body 3 and the end piece 4 radially outwardly to project from the groove for sliding engagement with the trochoidal inner wall surface 11*a* of the center housing 11.

As well known in the art, the side housing 6 has a stationary external gear 7 which is adapted to engage with an internal gear 9 provided in the rotor 8. Further, the rotor 8 is also provided with a roller bearing 10 which engage with an eccentric shaft (not shown) in a manner well known in the art.

In assembling the engine, the rotor 8 is mounted on one of the side housings 6 by providing corner seal means 12 between the side housing 6 and the rotor 8 and bringing the gear 9 into engagement with the gear 7 on the side housing 6. Then, the eccentric shaft is inserted into the roller bearing 10 and the center housing 11 is mounted on the side housing 6 in such a manner that the rotor 8 is encased in the center housing 11. In this instance, the apex seal main body 3 is inserted into each of the seal grooves 13 with the slanted cam surface 2 directed to the side opposite to the already assembled side housing 6. The arcuate leaf spring 5 is also inserted into the seal groove 13 so that its one end engages the stepped portion 3*a* on the main body 3 and the intermediate portion with the bottom of the associated seal groove 13. Therefore, the end piece 4 of the seal 1 is put in place with the stepped portion 4*a* receiving the other end of the spring 5. Finally, the other side housing 14 is mounted on the center housing 11 with side and corner seal means on the adjacent side of the rotor 8. In this instance, the end piece 4 is forced radially outwardly by the adjacent end 5' of the spring 5 and may be caught between the center housing 11 and the side housing 14. Thus, the tapered corner 4' on the end piece 4 and/or the corner portion 11' of the center housing may be damaged during assembling operation.

Figure 5:
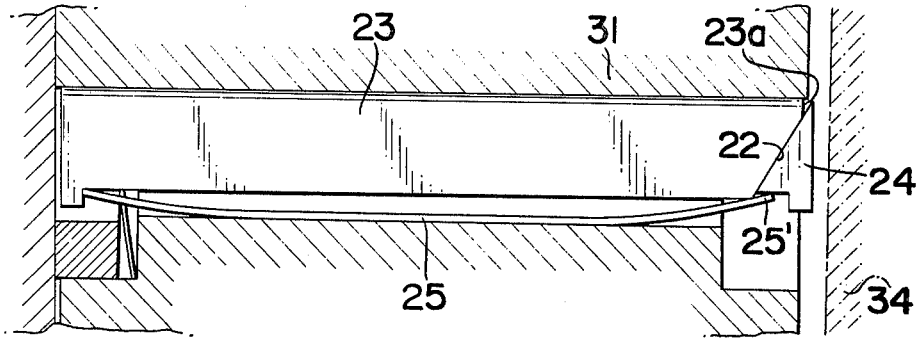
FIG. 5 PRIOR ART
FIG. 5 is a sectional view similar to FIG. 4 but showing a different type of apex seal.

FIG. 5 shows another type of apex seal means in which the main body 23 of the apex seal has a rectangular end face 23*a* on the end where a slanted cam surface 22 is provided. This type of apex seal may also have similar problems as in the previously described type of apex seal. Further, in this type, the end piece 24 may also be damaged by being compressed between the side housing 34 and the main body 23, and/or between the side housing 34 and the center housing 31.

Figure 6:
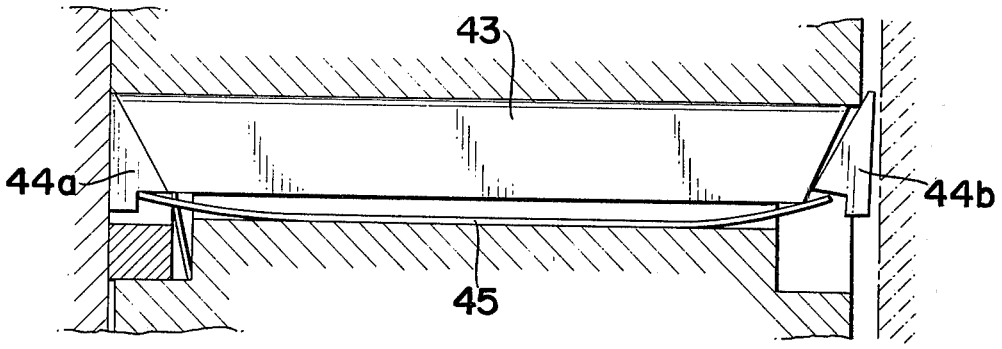
FIG. 6 PRIOR ART
FIG. 6 is a sectional view similar to FIGS. 4 and 5 but showing a further different type of apex seal.

In FIG. 6, there is shown an example of apex seal means in which a pair of end pieces 44*a* and 44*b* are provided at the opposite ends of the main body 43. In this arrangement, too, the end piece 44*b* may be encountered to similar problems in assembling the engine.

According to the present invention, the above problems can be eliminated by placing a projection or a block between the main body of the apex seal and the spring only during assembling operation in order that the end piece can be free from spring bias force.

Figure 7:
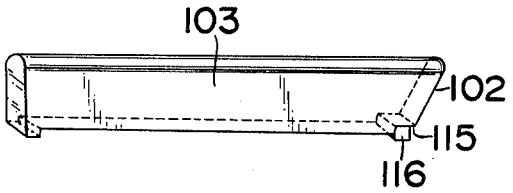
FIG. 7 is a perspective view of a main body of apex seal means having a projection provided in accordance with the method of the present invention.
Figure 8:
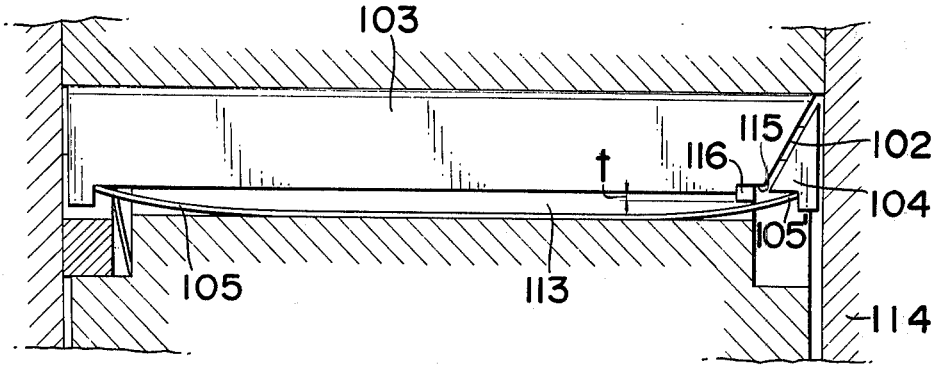
FIG. 8 is a sectional view showing the method in accordance with the present invention.

FIGS. 7 and 8 show an embodiment of the present invention in which the invention is applied to apex seal means of the type shown in FIG. 1. In the embodiment, the main body 103 is formed with a cut-off portion 115 on the bottom side thereof at the end adjacent to the end piece 104. A block 116 of consumable material is disposed on the cut-off portion 115 in such a manner that it projects from the bottom side of the main body 103 by the distance *t* as shown in FIG. 8. In assembling the engine, the block 116 engages the leaf spring 105 to retain the end 105' preventing the end piece 104 from being biased by the spring. Thus, the aforementioned problem can be completely eliminated. The block 116 is made of consumable material that is dissolved or burnt during the initial operation of the engine. Those materials that are dissolved at the temperature of 40° to 250° C, preferably 50° to 150° C, and most recommendably 60° to 80° C, can be used to provide the block 116. The lower limit of the temperature range is determined by the fact that the consumable material must be in solid form at the time of assembling. The upper limit is determined from the requirement that it must be dissipated during initial operation of the engine. Examples of such materials are ethylene-vinyl acetate copolymer, polyethylene, paraffine and wax. Further, those materials that are burnt under the heat produced during the initial operation of engine, such as paper can also be used. The block 116 may also be provided only by depositing suitable type of adhesive to a desired height.

In the embodiment shown in FIGS. 7 and 8, the block 116 of consumable material is attached to the main body 103 of the seal by a suitable adhesive and, during first engine operation, it is dissipated under the influence of heat so that the spring 105 is released to become engageable with the end piece 104 to force it against the slanted cam surface 102. Thus, the end piece 104 is also forced under the cam action of the surface 102 toward axial outward direction to engage the inner surface of the adjacent side housing 114.

Figure 9:
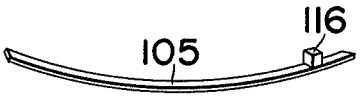
FIG. 9 is a perspective view of the leaf spring having a projection provided in accordance with the present invention.

The embodiment illustrated in FIGS. 7 and 8 provides further advantages in that the cut-off portion 115 formed on the main body 103 of the seal serves to determine the exact location of the block 116 of consumable material and further, after dissipation of the block 116, the cut-off portion 115 is effective to avoid interference between the main body 103 and the spring 105 even when the end 105' of the spring 105 is worn. However, it should be noted herein that the invention is not limited to the provision of such a cut-off portion. The block 116 of the consumable material may be attached to the spring 105 as shown in FIG. 9.

The present invention can be similarly applied to the seal structures as shown in FIGS. 5 and 6. In the structure of FIG. 6, the consumable projection may be provided only on one end of the main body or the spring 45, such as that adjacent to the end piece 44*b*.

The invention has thus been shown and described with reference to preferable embodiments, however, it should be noted that the invention is in no way limited to the details of the illustrated embodiments but changes and modifications may be made without departing from the scope of the appended claims.

We claim:

1. Method of assembling apex seal means in rotary piston engines comprising a casing which includes a center housing having a multiple-lobed trochoidal inner wall surface extending between the end faces of said center housing, and a pair of side housings airtightly secured to the end faces of the center housing to define a cavity with the center housing, and a substantially polygonal rotor defining axially extending apex seal grooves disposed in said cavity with the rotor apices in sliding engagement with the inner wall surface of the center housing, through apex seal means located in the apex seal grooves, said seal means including a main body having a slanted surface at one end, an end piece having a complementary slanted surface and a sealing surface, the slanted surface of said end piece being engaged with the slanted surface of the main body, and elongated spring means having one end engaging the main body and the other end positioned adjacent the slanted surface of the main body, engaging the end piece and normally biasing the end piece radially outwardly so that the biasing force of the spring means, and the coaction between the slanted surfaces biases the end piece radially and axially outwardly forcing the sealing surface of the end piece into sliding sealing engagement with the inner wall surface of the adjacent side housing, the method comprising the steps of; (a) providing a sub-assembly of one of the side housings, the central housing and the rotor, (b) disposing projection means of a material which can be dissipated by heat produced by engine operation between the main body and the spring means to hold retracted the end of the spring means adjacent the slanted surface of the main body, (c) inserting said main body and said spring means into an apex seal groove of said rotor in such a manner that the end of the main body having said slanted surface is facing the side of the center housing to which the other side housing is not yet attached, (d) placing the end piece in the seal groove adjacent said main body and said retained spring means such that the slanted surface of the end piece faces the slanted surface of the main body, with the end piece laying wholly within the center housing, not extending beyond the end face of the center housing, free of external stresses and not biased by said spring means because the spring means is being held retracted, and (e) mounting the other side housing on the end face of said center housing without disturbing the free and unstressed condition of the end piece, whereby the end piece is totally free of the biasing force of said spring means during the entire assembly operation, but is biased radially and axially outward into sealing engagement with the other side housing by the spring means and the coaction of the slanted surfaces when the projection means is dissipated by heat produced in engine operation.

2. Method in accordance with claim 1 comprising disposing the projection means on the main body.

3. Method in accordance with claim 1 comprising disposing the projection means on the spring means.

4. Method in accordance with claim 1 further comprising the step of (f) dissipating the projection means by engine operation.

5. Method in accordance with claim 1 in which said material constituting the projection means is of such a type that dissipates under temperature of 40° to 250° C.

6. Method in accordance with claim 1 in which said material constituting the projection means is of such a type that dissipates under temperature of 50° to 150° C.

7. Method in accordance with claim 1 in which said material constituting the projection means is of such a type that dissipates under temperature of 60° to 80° C.

8. Method in accordance with claim 1 in which said material constituting the projection means is selected from ethylene-vinyl acetate copolymer, polyethylene, paraffine and wax.

9. Method in accordance with claim 1 in which said projection means is provided by an adhesive that can be dissolved by heat produced during engine operation.

10. Method in accordance with claim 1 in which said material constituting the projection means is of such a type that is burnt under heat produced during engine operation.

11. Method in accordance with claim 10 in which said material is paper.

12. Method in accordance with claim 1 in which said main body is formed with a cut-off portion adjacent to the end where the slanted surface is formed and the projection means is located in the cut-off portion.

* * * * *